US009016312B2

(12) United States Patent
Yun et al.

(10) Patent No.: US 9,016,312 B2
(45) Date of Patent: Apr. 28, 2015

(54) FLUID FLOW CONTROL APPARATUS FOR HYDRAULIC PUMP OF CONSTRUCTION MACHINE

(75) Inventors: Hong Cheol Yun, Incheon (KR); Duc Woo Park, Incheon (KR)

(73) Assignee: Doosan Infracore Co., Ltd., Incheon (KR)

( * ) Notice: Subject to any disclaimer, the term of this patent is extended or adjusted under 35 U.S.C. 154(b) by 694 days.

(21) Appl. No.: 13/139,883

(22) PCT Filed: Dec. 15, 2009

(86) PCT No.: PCT/KR2009/007499

§ 371 (c)(1),
(2), (4) Date: Jun. 15, 2011

(87) PCT Pub. No.: WO2010/071344

PCT Pub. Date: Jun. 24, 2010

(65) Prior Publication Data

US 2011/0240147 A1 Oct. 6, 2011

(30) Foreign Application Priority Data

Dec. 15, 2008 (KR) ..... 10-2008-0126968

(51) Int. Cl.
*F04B 49/08* (2006.01)
*E02F 9/22* (2006.01)
*E02F 9/26* (2006.01)

(52) U.S. Cl.
CPC ..... *E02F 9/2235* (2013.01); *F04B 49/08* (2013.01); *E02F 9/268* (2013.01)

(58) Field of Classification Search
USPC ..... 417/46, 212–223; 172/3; 137/602
See application file for complete search history.

(56) References Cited

U.S. PATENT DOCUMENTS 4,638,779 A * 1/1987 Kitada ..... 123/385
4,838,755 A * 6/1989 Johnson et al. ..... 414/699
(Continued)

FOREIGN PATENT DOCUMENTS

EP 0504415 A1 9/1992
EP 1452743 A1 9/2004
(Continued)

OTHER PUBLICATIONS

Search Report mailed May 4, 2010 for International application PCT/KR2009/007499, filed Dec. 15, 2009 with an English translation attached.
(Continued)

*Primary Examiner* — William McCalister
(74) *Attorney, Agent, or Firm* — John D. Veldhuis-Kroeze; Westman, Champlin & Koehler, P.A.

(57) ABSTRACT

An apparatus for controlling the flow of a hydraulic pump of a construction machine according to the present disclosure includes: a pressure sensor detecting pressure signals corresponding to various control signal input values of the construction machine; a shuttle block including a plurality of shuttle valves dividing hydraulic lines connected with the pressure sensor into groups and extracting pressure oil of a hydraulic line under the highest pressure among hydraulic lines included in the corresponding group; auxiliary pressure sensors detecting the pressure of the pressure oil discharged from the shuttle block; electro proportional control valves in which opening rates are adjusted according to an applied signal and flows applied to signal lines are controlled to adjust discharge flows of main pumps; and a controller controlling the electro proportional control valves so that the opening rates of the electro proportional control valves are adjusted according to the magnitude of the pressure signal at the time of applying the pressure signal from the pressure sensor, wherein when the pressure sensor is judged as abnormal, the controller controls the operate rates of the electro proportional control valves to an opening rate corresponding to the magnitude of a signal outputted from the auxiliary pressure sensors.

6 Claims, 4 Drawing Sheets

(56) References Cited

U.S. PATENT DOCUMENTS

| | | | | | |
|---|---|---|---|---|---|
| 5,468,126 | A | * | 11/1995 | Lukich | 417/53 |
| 5,878,721 | A | * | 3/1999 | Nakamura | 123/496 |
| 5,940,997 | A | * | 8/1999 | Toyooka et al. | 37/411 |
| 6,020,651 | A | * | 2/2000 | Nakamura et al. | 290/40 R |
| 6,021,756 | A | * | 2/2000 | Nakamura | 123/385 |
| 6,161,522 | A | * | 12/2000 | Fuchita et al. | 123/385 |
| 6,183,210 | B1 | * | 2/2001 | Nakamura | 417/222.1 |
| 6,854,523 | B2 | * | 2/2005 | Takahashi | 172/3 |
| 6,966,614 | B2 | * | 11/2005 | Hamzeh et al. | 303/10 |
| 7,020,553 | B2 | * | 3/2006 | Nakamura et al. | 701/50 |
| 2003/0156949 | A1 | * | 8/2003 | Shimomura et al. | 417/213 |
| 2006/0018765 | A1 | * | 1/2006 | Fransson et al. | 417/213 |

FOREIGN PATENT DOCUMENTS

| | | | |
|---|---|---|---|
| EP | 1669613 | A1 | 6/2006 |
| JP | 08-085974 | A | 4/1996 |
| JP | H1182416 | A | 3/1999 |
| JP | 2003-239908 | A | 8/2003 |
| JP | 2004-535326 | A | 11/2004 |
| KR | 10-1992-0006546 | B1 | 8/1992 |
| KR | 10-0120281 | B1 | 10/1997 |

OTHER PUBLICATIONS

Extended European Search Report dated Nov. 12, 2014 for corresponding European Application No. 09833622.5, 5 pages.

* cited by examiner

FLUID FLOW CONTROL APPARATUS FOR HYDRAULIC PUMP OF CONSTRUCTION MACHINE

This Application is a Section 371 National Stage Application of International Application No. PCT/KR2009/007499, filed Dec. 15, 2009 and published, not in English, as WO2010/071344 on Jun. 24, 2010.

FIELD OF THE DISCLOSURE

The present disclosure relates to a construction machine using an oil pressure as a driving source of a working apparatus, such as an excavator, and the like, and more particularly, to an apparatus for controlling the flow of a hydraulic pump of a construction machine for supplying a working fluid to each working apparatus.

BACKGROUND OF THE DISCLOSURE

In general, a construction machine such as an excavator includes a plurality of actuators for travelling or driving various working apparatuses and the plurality of actuators are driven by a working fluid discharged from a variable-displacement-type hydraulic pump driven by an engine.

Meanwhile, the output of the engine and the flow of the working fluid discharged from the variable-displacement-type hydraulic pump are controlled based upon a work load. One example of an apparatus for controlling the flow of the hydraulic pump is shown in FIG. 1.

Referring to FIG. 1, a general construction machine includes two main pumps P1 and P2 and one auxiliary pump P3 driven by an engine E. The main pumps P1 and P2 are constituted by variable-displacement-type pumps where the discharged flow varies depending on angles of swash plates 1*a* and 1*b*. In the case of the main pumps P1 and P2, gradient angles of the swash plates 1*a* and 1*b* are controlled by driving servo pistons 2*a* and 2*b* to control the flow.

The servo pistons 2*a* and 2*b* are driven by working fluids of the main pumps P1 and P2 where flowing directions thereof are controlled by the swash plate control valves 5*a* and 5*b*. The swash plate control valves 5*a* and 5*b* are changed by driving multi-step pistons 6*a* and 6*b* and the multi-step pistons 6*a* and 6*b* are driven by flow control pistons 7*a* and 7*b*. That is, the gradient angles of the swash plates 1*a* and 1*b* of the main pumps P2 and P2 are controlled by driving the flow control pistons 7*a* and 7*b*.

Further, the flow control pistons 7*a* and 7*b* are driven depending on the flow discharged from electro proportional control valves 8*a* and 8*b* of which an opening rate is controlled according to a current amount which is a signal applied from a controller 9.

More specifically, a pressure sensor 10 is provided on each of hydraulic control lines of a joystick of the excavator and various travelling control devices (not shown). When a user controls the joystick and various travelling control devices, the pressure sensor 10 recognizes signals depending on motions thereof and transmits the signals to the controller 9. The controller 9 uses an inputted pressure sensor value and outputs a signal corresponding thereto, i.e., the current amount, to the electro proportional control valves 8*a* and 8*b* so as to control the opening rates of the electro proportional control valves 8*a* and 8*b*, and as a result, the discharge flows of the main pumps P1 and P2 are appropriately controlled.

However, in case where the pressure sensor 10 is abnormal, the pressure sensor 10 cannot accurately detect the motions of the joystick and the various control devices and a pressure sensor value that is incorrectly detected is inputted into the controller 9, and as a result, the discharge flows of the main pumps P1 and P2 are not accurately controlled. Therefore, the construction machine does not operate or operates erroneously. Further, even when the error of the pressure sensor 10 is recognized, the construction machine cannot but stop until repairs can be completed.

The discussion above is merely provided for general background information and is not intended to be used as an aid in determining the scope of the claimed subject matter.

SUMMARY

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The present disclosure is contrived to consider the above-mentioned points and an object of the present disclosure is to provide an apparatus for controlling the flow of a hydraulic pump of a construction machine that is capable of performing optimal control even when a pressure sensor is defective.

Further, another object of the present disclosure is to provide a hydraulic pump flow controlling apparatus for a construction machine that is capable of preventing danger in an emergency situation such as occurrence of a defect of a control line and removing inconvenience due to discontinuation of use before equipment repairing is completed.

In order to achieve the above-mentioned or other beneficial objects, an apparatus for controlling the flow of a hydraulic pump of a construction machine according to the present disclosure includes: a pressure sensor 80 for detecting pressure signals corresponding to various control signal input values of the construction machine; a shuttle block 70 including a plurality of shuttle valves 70*a* and 70*b* dividing hydraulic lines 81 connected with the pressure sensor 80 into groups and extracting pressure oil of a hydraulic line under the highest pressure among hydraulic lines 81 included in the corresponding group; auxiliary pressure sensors 60*a* and 60*b* detecting the pressure of the pressure oil discharged from the shuttle block 70; electro proportional control valves 40*a* and 40*b* in which opening rates are adjusted according to an applied signal and flows applied to signal lines 33*a* and 33*b* are controlled to adjust discharge flows of main pumps P1 and P2; and a controller 50 for controlling the electro proportional control valves 40*a* and 40*b* such that the opening rates of the electro proportional control valves 40*a* and 40*b* are adjusted according to the magnitude of the pressure signal at the time of applying the pressure signal from the pressure sensor 80, in which when the pressure sensor 80 is judged as abnormal, the controller 50 controls the operate rates of the electro proportional control valves 40*a* and 40*b* to an opening rate corresponding to the magnitude of a signal outputted from the auxiliary pressure sensors 60*a* and 60*b*.

According to an exemplary embodiment of the present disclosure, the controller may judge whether the pressure sensor 80 is abnormal by comparing auxiliary pressure sensor values applied from the auxiliary pressure sensors 60*a* and 60*b* with the largest signal value among the signals applied from the pressure sensor 80.

Further, the auxiliary pressure sensors 60*a* and 60*b* and the shuttle valves 70*a* and 70*b* may be provided with the number corresponding to the number of the main pumps P1 and P2, and the controller may control the electro proportional control valves 40*a* and 40*b* based on the signals of the auxiliary pressure sensors 60*a* and 60*b*, respectively when the pressure sensor is abnormal.

The apparatus may further include an auxiliary mode switch 90 connected with the controller 50 and selectively outputting an auxiliary mode signal to the controller 50 and the controller 50 may output a signal corresponding to a predetermined value to the electro proportional control valves 40*a* and 40*b* when the auxiliary mode signal is inputted.

Further, the auxiliary mode switch 90 may operate when both the pressure sensor and the auxiliary sensors are abnormal, and the controller may output a signal corresponding to a predetermined value to the electro proportional control valves 40*a* and 40*b* when the auxiliary mode signal is inputted.

Meanwhile, the above-mentioned objects may be achieved by an apparatus for controlling the flow of a hydraulic pump of a construction machine including: a pressure sensor 80 for detecting pressure signals corresponding to various control signal input values of the construction machine; electro proportional control valves 40*a* and 40*b* in which opening rates are adjusted according to an applied signal and flows applied to signal lines 33*a* and 33*b* are controlled so as to adjust discharge flows of main pumps P1 and P2; a controller 50 for controlling signals applied to the electro proportional control valves 40*a* and 40*b* by detecting the largest pressure signal value among pilot signals 82 of the pressure signals applied from the pressure sensor 80; and an auxiliary mode switch 90 connected with the controller 50 and applying an auxiliary mode signal to the controller 50, wherein the controller 50 outputs a signal corresponding to the largest pressure signal value of the pressure sensor 80 to the electro proportional control valves 40*a* and 40*b* in a normal mode operation and outputs a signal corresponding to a predetermined value to the electro proportional control valves 40*a* and 40*b* in an auxiliary mode operation.

According to means for solving the problem as described above, a hydraulic pump flow controlling apparatus of a construction machine according to the present disclosure includes an auxiliary pressure sensor to optimally control a discharge flow of a main pump even when a pressure sensor is defective.

Further, the discharge flow of the main pump is controlled by comparing a signal of the pressure sensor and a signal of the auxiliary pressure sensor so as to control the construction machine accurately.

In addition, the hydraulic pump flow controlling apparatus further includes an auxiliary mode switch to prevent danger in an emergency situation such as occurrence of a defect of a control line and operates in an auxiliary mode even before equipment can be repaired to minimize inconvenience due to discontinuation of use.

DETAILED DESCRIPTION

Exemplary embodiments of the present disclosure of an apparatus for controlling the flow of a hydraulic pump of a construction machine according to the present disclosure will be described in detail with reference to the accompanying drawings.

Figure 1:
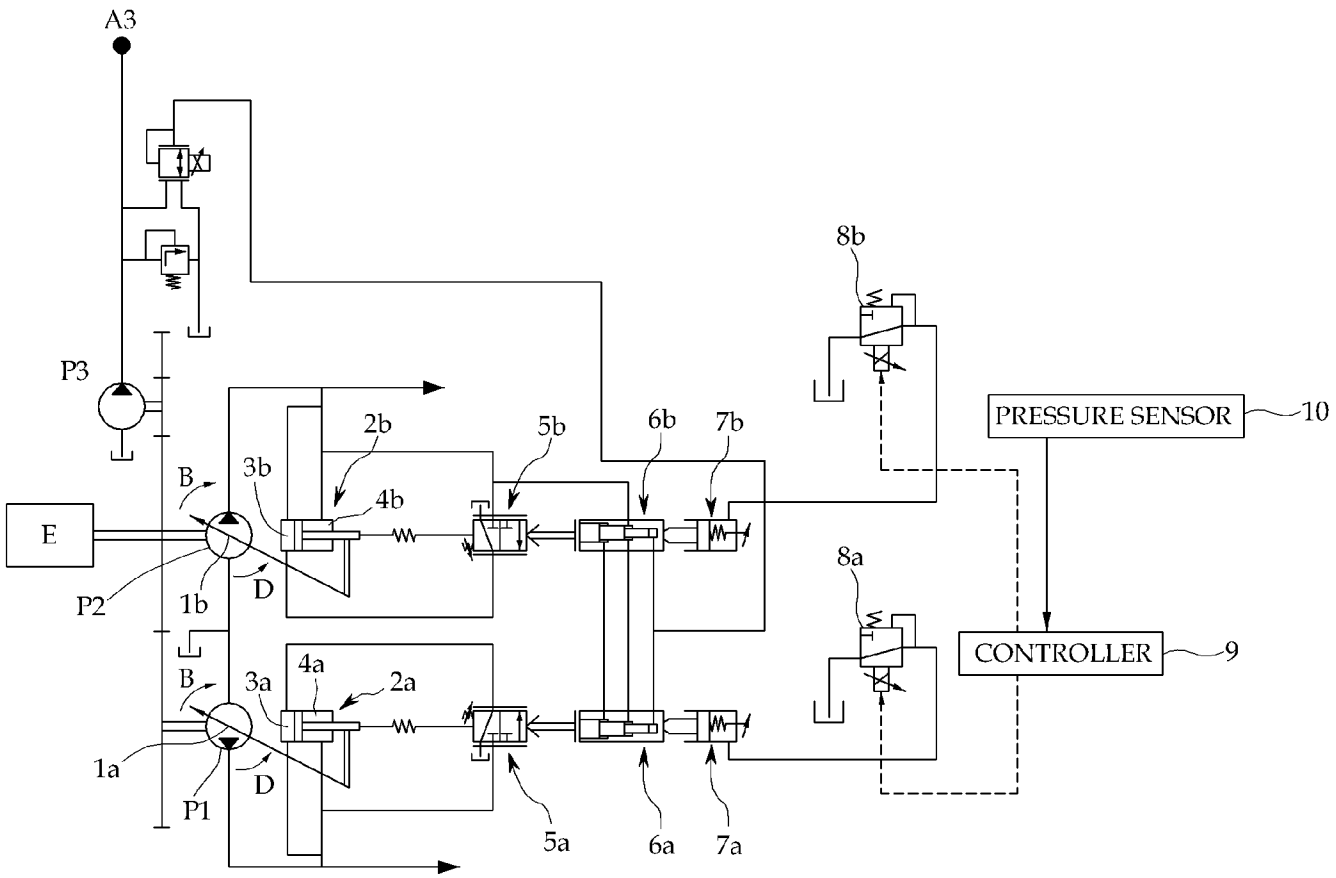
FIG. 1 is a hydraulic circuit diagram schematically showing a general apparatus for controlling the flow of a hydraulic pump of a construction machine.
Figure 2:
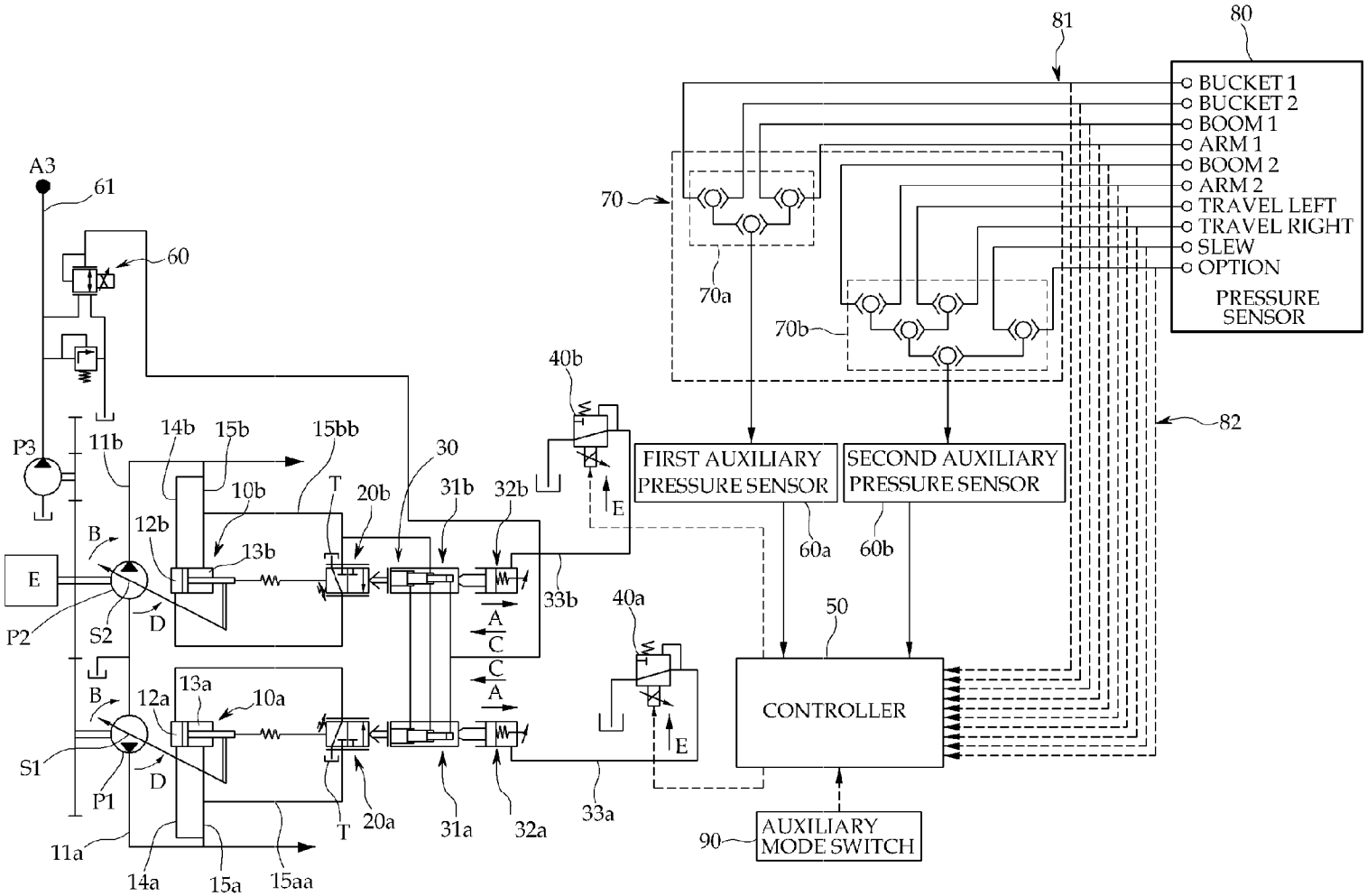
FIG. 2 is a hydraulic circuit diagram schematically showing an apparatus for controlling the flow of a hydraulic pump of a construction machine according to an exemplary embodiment of the present disclosure.

FIG. 2 is a hydraulic circuit diagram schematically showing an apparatus for controlling the flow of a hydraulic pump of a construction machine according to an exemplary embodiment of the present disclosure.

Referring to FIG. 2, an apparatus for controlling the flow of a hydraulic pump according to an exemplary embodiment of the present disclosure, which serves to control discharge flows of a pair of main pumps P1 and P2 driven by an engine E, includes servo pistons 10*a* and 10*b* connected to swash plates S1 and S2 to control gradient angles of the swash plates S1 and S2 of the main pumps P1 and P2, swash plate control valves 20*a* and 20*b* for controlling a flowing direction of a working fluid supplied to the servo pistons 10*a* and 10*b*, a valve switching unit 30 for switching the swash plate control valves 20*a* and 20*b* based on an inputted signal, electro proportional control valves 40*a* and 40*b* for applying signals for switching the swash plate control valves 20*a* and 20*b* to the valve switching unit 30, and a controller 50 for controlling the electro proportional control valves 40*a* and 40*b*.

Further, the hydraulic pump flow controlling apparatus includes a pressure sensor 80 provided on hydraulic control lines of a joystick and various travelling control devices (not shown, hereinafter, referred to as an 'input unit') to recognize a signal depending on a motion of the input unit, a shuttle block 70 including a plurality of shuttle valves 70*a* and 70*b* connected to hydraulic lines 81 passing through the pressure sensor 80, and auxiliary pressure sensors 60*a* and 60*b* for detecting the pressure of pressure oil discharged from the shuttle valves 70*a* and 70*b*. The exemplary embodiment will be described only in reference to the situation where pilot signals generated by operating the joystick and the control devices are hydraulic signals. The hydraulic signals generated as above are applied to a pressure receiving portion of a control spool controlling working devices by passing through the pressure sensor 80 although not shown and branched before being applied to the pressure receiving portion, and as a result, the flow partially flows into the shuttle block 70. In this embodiment, an example is described where only a pair of shuttle valves 70*a* and 70*b* are provided for simplicity purposes. The shuttle valves 70*a* and 70*b* are preferably grouped according to the number of pumps. The reason for that is that signals generated from individual shuttle valves 70*a* and 70*b* are used to control corresponding pumps as described below. As a result, in the case of the number of pumps being 3, the shuttle valves 70*a* and 70*b* are also preferably provided as three assemblies according to the number of the corresponding pumps. Therefore, the auxiliary pressure sensors 60*a* and 60*b* are also preferably installed as three assemblies. Meanwhile, the hydraulic pump flow controlling apparatus may further include an auxiliary mode switch 90 for applying an auxiliary mode operation signal to the controller 50.

In the shuttle block 70, as shown in FIG. 2, various pressure signals of the pressure sensor 80 are separated into small groups, e.g., part 1 and part 2 and the shuttle valves 70*a* and 70*b* connected with hydraulic lines 81 corresponding to each part are bound for each part. As a result, the largest value among pressure signal values of part 1 is outputted through the shuttle valve 70*a* and the largest value among pressure signal values of part 2 is outputted through the shuttle valve 70*b*. Further, a first auxiliary pressure sensor 60*a* and a second auxiliary pressure sensor 60*b* are provided to detect the pressure of the pressure oil discharged from the shuttle block 70 for each part. Hereinafter, a detailed description thereof will be made.

The main pumps P1 and P2 are configured by variable displacement type pumps in which a discharge flow is controlled according to gradient angles of the swash plates S1 and S2 and although the main pumps are configured by two in the exemplary embodiment, the number thereof may vary depending on the construction machine. The main pumps P1 and P2 are mechanically connected to the engine E to convert mechanical energy of the engine E into hydraulic energy and the working fluid discharged from the main pumps P1 and P2 is transported to a main control valve block through main supply lines 11*a* and 11*b* and the transported working fluid is supplied to the working devices while the flowing direction of the working fluid is controlled by each control valve of the main control valve block. Further, the working fluid discharged from the main pumps P1 and P2 is supplied to large-diameter chambers 12*a* and 12*b* and small-diameter chambers 13*a* and 13*b* of the servo pistons 10*a* and 10*b*, respectively by branch lines 14*a*, 14*b*, 15*a*, and 15*b* branched from the main supply lines 11*a* and 11*b*.

The servo pistons 10*a* and 10*b* are connected with the swash plates S1 and S2 to control the angles of the swash plates S1 and S2 and include the large-diameter chambers 12*a* and 12*b* where a cross-sectional area of the pressure receiving portion is large and the small-diameter chambers 13*a* and 13*b* where a cross-sectional area of the pressure receiving portion is small. As described above, the working fluid of the main pumps P1 and P2 is supplied to the large-diameter chambers 12*a* and 12*b* and the small-diameter chambers 13*a* and 13*b* through the branch lines 14*a*, 14*b*, 15*a*, and 15*b* branched from the main supply lines 11*a* and 11*b*. The working fluid is supplied to the small-diameter chambers 13*a* and 13*b* at all times, but the working fluid is supplied to or drained from the large-diameter chambers 12*a* and 12*b* according to switching states of the swash plate control valves 20*a* and 20*b*.

When the working fluid is supplied to the large-diameter chambers 12*a* and 12*b*, the areas of the pressure receiving portions of the large-diameter chambers 12*a* and 12*b* are larger than those of the small-diameter chambers 13*a* and 13*b*, and as a result, the servo pistons 10*a* and 10*b* are driven in an extending direction thereof and thus the swash plates S1 and S2 rotate so as to increase the discharge flow of the main pumps P1 and P2. On the other hand, when the working fluid of the large-diameter chambers 12 and 12*b* is drained, the servo pistons 10*a* and 10*b* are driven in a contracting direction, thus, the swash plates S1 and S2 rotate so as to decrease the discharge flow of the main pumps P1 and P2.

The swash plate control valves 20*a* and 20*b* are at one side connected with a drain tank T and also with lines 15*aa* and 15*bb*, branched from the branch lines 15*a* and 15*b* connected with the small-diameter chambers 13*a* and 13*b* of the servo pistons 10*a* and 10*b*, respectively, and at the other side connected with the large-diameter chambers 12*a* and 12*b* of the servo pistons 10*a* and 10*b*, respectively. When the swash plate control valves 20*a* and 20*b* are switched as shown in FIG. 2, the working fluid of the large-diameter chambers 12*a* and 12*b* is drained to the drain tank T and the working fluid is supplied to the small-large chambers 13*a* and 13*b*, and as a result, the servo pistons 10*a* and 10*b* are driven in the contracting direction.

On the other hand, when the swash plate control valves 20*a* and 20*b* are switched in a state opposite to the state shown in FIG. 2, the large-diameter chambers 12*a* and 12*b* of the servo pistons 10*a* and 10*b* are interrupted from the drain tank T and connected with the small-diameter chambers 13*a* and 13*b* through the branch lines 15*aa* and 15*bb* to receive the working fluid of the small-diameter chambers 13*a* and 13*b* and the working fluid of the branch lines 15*a* and 15*b* branched from the main supply lines 11*a* and 11*b*. As a result, the servo pistons 10*a* and 10*b* are driven in the extending direction.

The valve switching unit 30 serving to switch the swash plate control valves 20*a* and 20*b* includes multi-step pistons 31*a* and 31*b* for switching the swash plate control valves 20*a* and 20*b* and flow control pistons 32*a* and 32*b* for driving the multi-step pistons 31*a* and 31*b*.

The multi-step pistons 31*a* and 31*b* are connected with the branch lines 15*aa* and 15*bb* connected to the swash plate control valves 20*a* and 20*b* to be changed according to the pressure of the working fluid discharged from the main pumps P1 and P2 and connected with an auxiliary pump P3 through a horsepower control valve 60 to be driven by receiving the pressure of a working fluid discharged from the auxiliary pump P3 according to a switching state of the horsepower control valve 60. The horsepower control valve 60 is connected in signal communication (not shown) with the controller 50 to supply the working fluid of the auxiliary pump P3 to the multi-step pistons 31*a* and 31*b* according to the selected horsepower mode, thereby controlling the angles of the swash plates S1 and S2. Further, the multi-step pistons 31*a* and 31*b* are driven by the flow control pistons 32*a* and 32*b*.

The flow control pistons 32*a* and 32*b* are driven by receiving signals from the electro proportional control valves 40*a* and 40*b* through signal lines 33*a* and 33*b*. For example, when high-pressure signals are supplied to the flow control pistons 32*a* and 32*b* through the signal lines 33*a* and 33*b*, the flow control pistons 32*a* and 32*b* are driven in A direction to move the multi-step pistons 31*a* and 31*b* in the A direction. On the contrary, when low-pressure signals are supplied to the flow control pistons 32*a* and 32*b* through the signal lines 33*a* and 33*b*, the flow control pistons 32*a* and 32*b* are driven in C direction to move the multi-step pistons 31*a* and 31*b* in the C direction.

The electro proportional control valves 40*a* and 40*b* serve to supply the signals for switching the swash plate control valves 20*a* and 20*b* to the flow control pistons 32*a* and 32*b* and opening rates thereof are controlled depending on a current amount which is a signal supplied from the controller 50.

The controller 50 serving to control the electro proportional control valves 40*a* and 40*b* determines an output value by comparing pilot signals 82 of the pressure signals detected by the pressure sensor 80 with values of the auxiliary pressure sensors 60*a* and 60*b*. As the output value increases the controller 50 drives the flow control pistons 32*a* and 32*b* to increase the discharge flows of the main pumps P1 and P2 by increasing the opening rates of the electro proportional control valves 40*a* and 40*b*. As the output value decreases the controller 50 drives the flow control pistons 32*a* and 32*b* to decrease the discharge flows of the main pumps P1 and P2 by decreasing the opening rates of the electro proportional control valves 40*a* and 40*b*. Accordingly, the discharge flows of the main pumps P1 and P2 can be controlled according to a work load.

The auxiliary pressure sensors 60and 60*b* serve to detect the pressure of the pressure oil discharged from the shuttle block 70. The first auxiliary pressure sensor 60*a* detects the pressure of the pressure oil discharged from the shuttle valve 70*a* and the second auxiliary pressure sensor 60*b* detects the pressure of the pressure oil discharged from the shuttle valve 70*b*. The auxiliary pressure sensor values detected by the auxiliary pressure sensors 60*a* and 60*b* are transmitted to the controller 50.

The shuttle block 70 is configured by a set of a plurality of shuttle valves 70*a* and 70*b*. As described above, the pressure sensor 80 detects various pressure signals, e.g., pressure signals associated with boom falling, boom rising, arm unfolding, arm folding, bucket unfolding, bucket folding, left swing, right swing, left forward and backward travelling, right forward and backward travelling, and the like. The pressure signals are classified into two small groups. As a reference to classifying the pressure signals into part 1 and part 2, a group of pressure signals to operate the main pump P1 is classified by part 1 and a group of pressure signals to operate the main pump P2 is classified by part 2. For example, the pressure signals of the pressure sensor 80 associated with boom falling, arm unfolding, bucket unfolding, and bucket folding are included in part 1 and the pressure signals of the pressure sensor 80 associated with boom rising, arm folding, left swing, right swing, left forward and backward travelling, right forward and backward travelling are included in part 2. Meanwhile, the pressure signals are not necessarily classified into two small groups, and types of the pressure signals included in each small group also are not limited to the above-mentioned examples and may be arbitrarily changed according to a driving condition or environment.

Various pressure signals of the pressure sensor 80 are inputted into the shuttle block 70 along the hydraulic lines 81. In this case, the pressure signals of the pressure sensor 80 corresponding to part 1 are supplied to the first shuttle valve 70*a* and the pressure signals of the pressure sensor 80 corresponding to part 2 are supplied to the second shuttle valve 70*b*. By the configuration shown in FIG. 2, a signal having the largest pressure value among the pressure signals inputted into inlet ports of the first shuttle valve 70*a* is outputted through an outlet port to be inputted into the first auxiliary pressure sensor 60*a* and a signal having the largest pressure value among the pressure signals inputted into inlet ports of the second shuttle valve 70*b* are outputted through an outlet port to be inputted into the second auxiliary pressure sensor 60*b*.

Meanwhile, various pressure signals detected by the pressure sensor 80 are inputted into the shuttle block 70 through the hydraulic line 81 as described above and in addition, pilot signals 82 of the pressure signals are inputted into the controller 50. As a result, the controller 50 controls signals supplied to the electro proportional control valves 40*a* and 40*b* by comparing pressure signal values of the pilot signals 82 and auxiliary pressure sensor values of the auxiliary pressure sensors 60*a* and 60*b*.

The auxiliary mode switch 90 serves to supply an auxiliary mode signal to the controller 50. When the pressure sensor 80 and the auxiliary pressure sensors 60*a* and 60*b* are all defective, the controller 50 recognizes the auxiliary mode signal by operating the auxiliary mode switch 90 and sends a predetermined current amount to the electro proportional control valves 40*a* and 40*b* to determine discharge amounts of the main pumps P1 and P2.

Hereinafter, a flow control process of the apparatus for controlling the flow of the hydraulic pump of the construction machine, which has the above-mentioned configuration, will be described in detail with reference to FIGS. 3 and 4.

First, a control process of driving the main pump P1 will be described.

Figure 3:
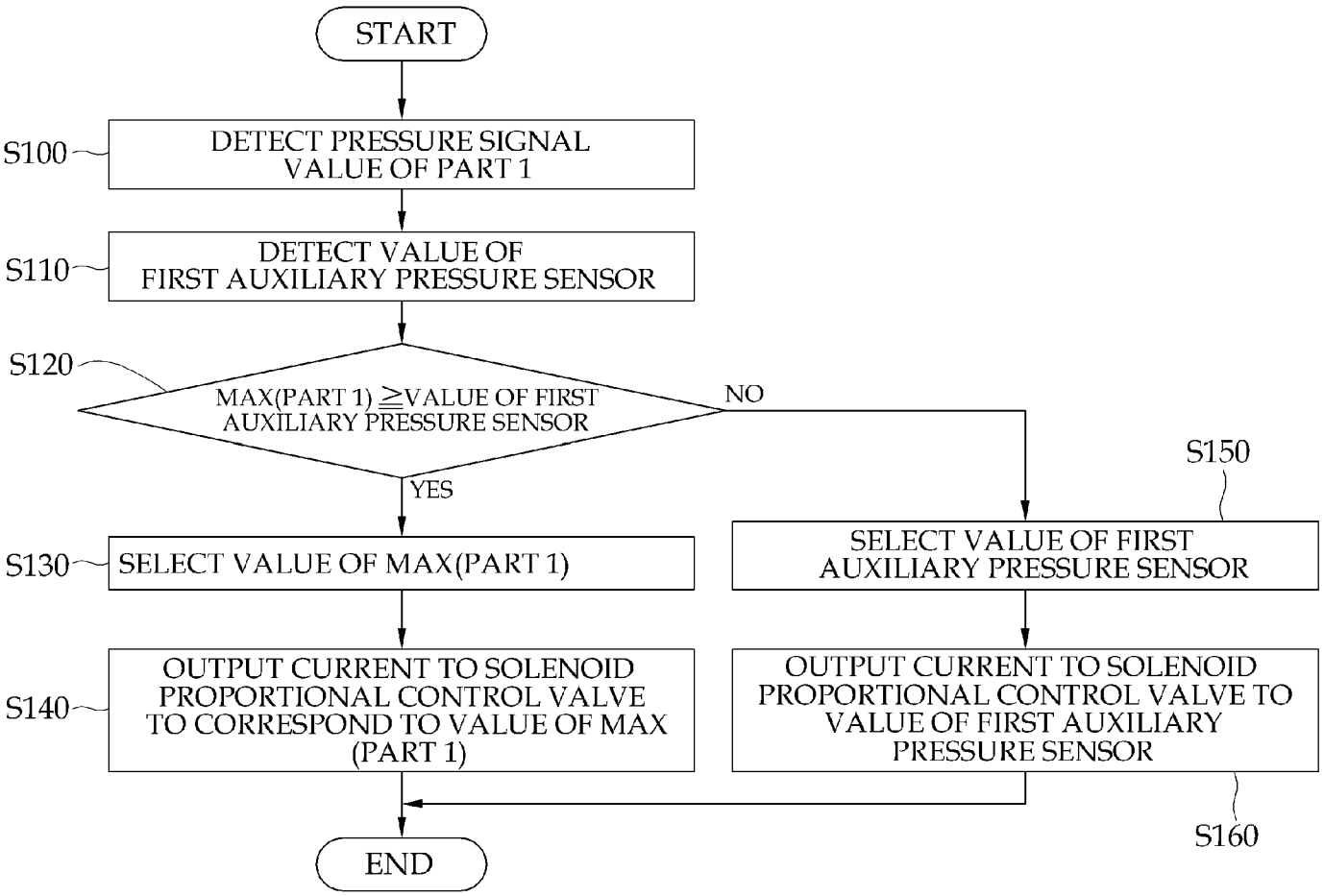
FIGS. 3 and 4 are flowcharts showing a process of controlling the flow of a hydraulic pump of a construction machine according to an exemplary embodiment of the present disclosure.

Referring to FIG. 3, the pilot signals 82 of the pressure signals corresponding to part 1 among various pressure signals detected by the pressure sensor 80 is transmitted to the controller 50 and the controller detects the largest pressure signal value Max (part 1) among the pilot signals 82 (S100).

Further, the pressure signals of part 1 detected by the pressure sensor 80 are inputted into the shuttle valve 70*a* along the hydraulic line 81 and the largest pressure value is discharged from the shuttle valve 70*a* and the first auxiliary pressure sensor 60*a* thus detects the discharged pressure value as a value of the first auxiliary pressure sensor 60*a* (S110).

Then, the controller 50 judges whether the detected pressure signal value of part 1 Max (part 1) is equal to or larger than the value of the first auxiliary pressure sensor 60*a* (S120).

When the pressure sensor 80 is not defective, the pressure signal value of part 1 Max (part1) is equal to the value of the first auxiliary pressure sensor 60*a*. Accordingly, when the pressure signal value of part 1 Max (part1) is equal to or larger than the value of the first auxiliary pressure sensor 60*a*, the controller judges that the pressure sensor 80 is not defective to select the pressure signal value of part 1 Max (part1)) (S130).

Then, a current is outputted to the electro proportional control valve 40*a* so as to correspond to the pressure signal value of part 1 Max (part1) (S140). As a result, the discharge flow of the main pump P1 is controlled to correspond to an input value of the input unit.

Meanwhile, when the pressure signal value of part 1 Max (part1) is not equal to or larger than the value of the first auxiliary pressure sensor 60*a*, the controller judges that the pressure sensor 80 is defective to select the value of the first auxiliary pressure sensor 60*a* which is a value acquired by directly detecting the pressure of the flow through the hydraulic line 81 (S150).

Then, a current is outputted to the electro proportional control valve 40*a* to correspond to the value of the first auxiliary pressure sensor 60*a* (S160). As a result, the discharge flow of the main pump P1 is controlled to correspond to an input value of the input unit.

According to the present disclosure, the discharge flow of the main pump P1 can be optimally controlled even when the pressure sensor 80 is defective by using the first auxiliary pressure sensor 60*a* accurately detecting the pressures of the pressure signals.

Next, a control process of driving the main pump P2 will be described.

Figure 4:
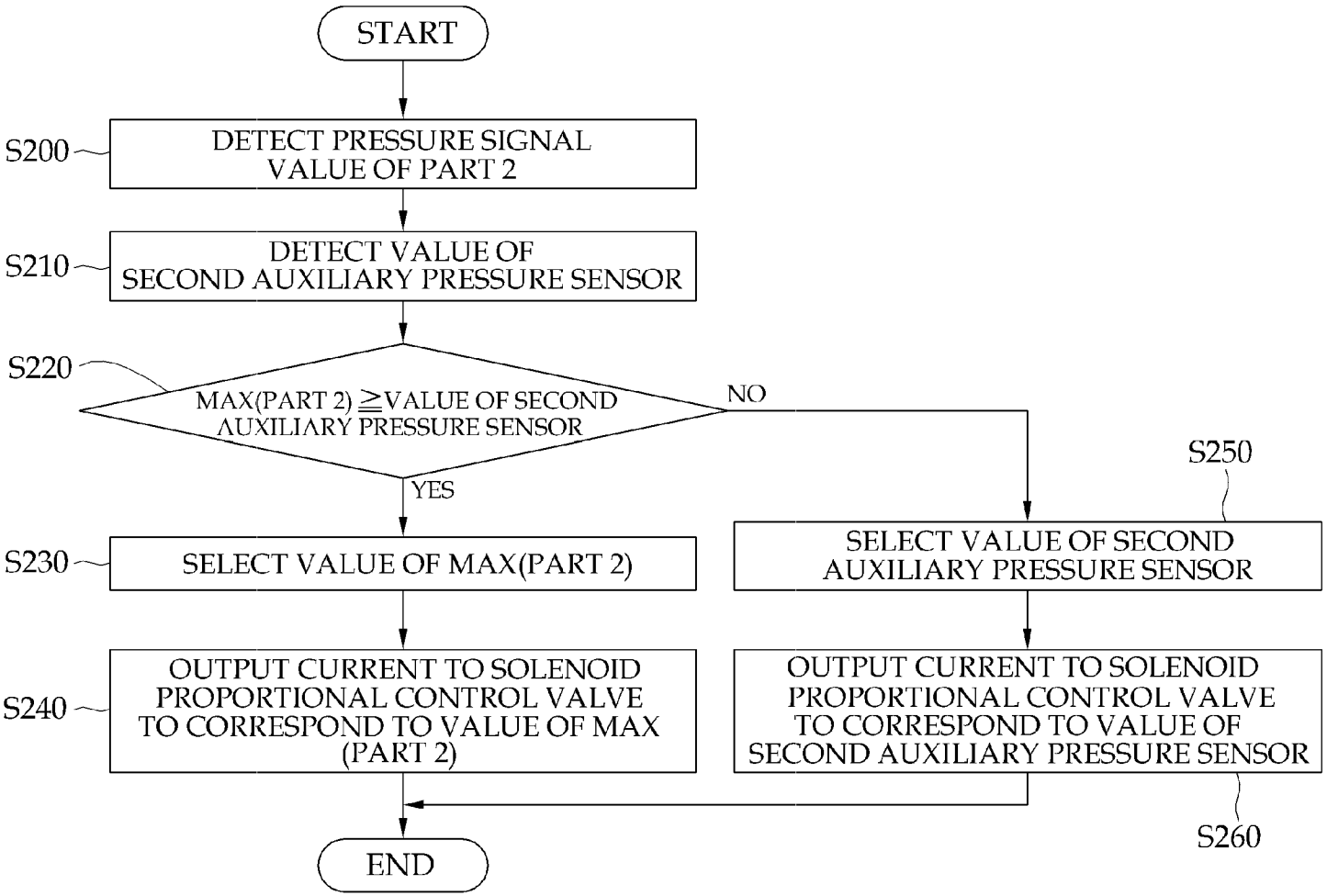

Referring to FIG. 4, in correspondence with the control process of the main pump 1, a pressure signal value of part 2 Max (part 2) and a value of the second auxiliary pressure sensor 60*b* are detected (S200 and S210) and the controller 50 judges whether the pressure signal value of part 2 Max (part 2) is equal to or larger than the value of the second auxiliary pressure sensor 60*b* (S220).

When the pressure signal value of part 2 Max (part 2) is equal to or larger than the value of the second auxiliary pressure sensor 60*b*, the opening rate of the electro proportional control valve 40*b* is controlled to correspond to the pressure signal value of part 2 Max (part 2) (S230 and S240) and when the pressure signal value of part 2 Max (part 2) is not equal to or larger than the value of the second auxiliary pressure sensor 60*b*, the opening rate of the electro proportional control valve 40*b* is controlled so as to correspond to the value of the second auxiliary pressure sensor 60*b* (S250 and S260). As such, the discharge flow of the main pump P2 can be optimally controlled even when the pressure sensor 80 is defective by using the second auxiliary pressure sensor 60*b*.

Hereinafter, an apparatus for controlling the flow of a hydraulic pump according to another exemplary embodiment of the present disclosure will be described.

Referring back to FIG. 2, in case where even the auxiliary pressure sensors 60*a* and 60*b* configured as above are defective, the flow controlling apparatus can be driven in the auxiliary mode by operating the auxiliary mode switch 90. The auxiliary mode switch 90 may be provided in an operating room so that an operator can sense a defect and operate the switch, and may be configured even as a type of a sensor that senses errors of the pressure sensor and the auxiliary pressure sensors and transmits the errors to the controller to enable the flow controlling apparatus to be automatically converted to the auxiliary mode.

More specifically, when the auxiliary mode switch 90 operates, the controller 50 recognizes the operation to enter the auxiliary mode. The controller 50 supplies a predetermined current amount to the electro proportional control valves 40*a* and 40*b* regardless of the values of the auxiliary pressure sensors 60*a* and 60*b* and the pilot signal 82 of the pressure sensor 80. As a result, the opening rates of the electro proportional control valves 40*a* and 40*b* are set constantly and the discharge amounts of the main pumps P1 and P2 are also determined so as to correspond thereto, and thus a predetermined, minimally required power can be provided in an emergency situation. Accordingly, the construction machine can be moved under a danger caused due to a malfunction of the working device and in a dangerous area.

Further, according to yet another exemplary embodiment of the present disclosure, the flow controlling apparatus is configured by only the auxiliary mode switch 90 with the auxiliary pressure sensors 60*a* and 60*b* omitted, and as a result, the flow controlling apparatus can be controlled to operate in the auxiliary mode when the pressure sensor 80 is defective.

The exemplary embodiments of the present disclosure are disclosed to achieve the above-mentioned or other beneficial objects and various modifications, changes, and additions will be made within the spirit and scope of the present disclosure by those skilled in the art and it will be understood that these modifications, changes, and additions are included in the appended claims.

The present disclosure can be applied to all construction machines that use a hydraulic pump in addition to an excavator or a wheel loader.

The invention claimed is:

1. An apparatus for controlling the flow of a hydraulic pump of a construction machine, comprising:

a pressure sensor configured to detect pressure signals corresponding to various control signal input values of the construction machine;

a shuttle block coupled to the pressure sensor and having a plurality of shuttle valves configured to extract pressure oil from a hydraulic line having the highest pressure among hydraulic lines connected with the pressure sensor, which are divided into groups, within the respective group, and to discharge the pressure oil from the hydraulic line having the highest pressure;

an auxiliary pressure sensor coupled to the shuttle block and configured to detect the pressure of the pressure oil discharged from the shuttle block;

an electro proportional control valve configured to control flows to a signal line with an opening rate being adjusted according to a signal supplied thereto, to adjust discharge flow of a main pump; and a controller coupled to the auxiliary pressure sensor such that the shuttle block and auxiliary pressure sensor are operably coupled between the sensor and the controller, the controller configured to control the electro proportional control valve such that the opening rate of the electro proportional control valve is adjusted according to the magnitude of the pressure signal supplied from the pressure sensor;

wherein the controller is further configured to determine whether the pressure sensor is abnormal, and when the pressure sensor is determined to be abnormal, the controller controls the opening rate of the electro proportional control valve to an opening rate corresponding to the magnitude of a signal outputted from the auxiliary pressure sensor.

2. The apparatus of claim 1, wherein the controller determines whether the pressure sensor is abnormal by comparing auxiliary pressure sensor value supplied from the auxiliary pressure sensor with the largest signal value among the signals applied from the pressure sensor.

3. The apparatus of claim 1, wherein the auxiliary pressure sensor and the shuttle valves are provided to a number corresponding to a number of main pumps; and the controller controls the electro proportional control valve corresponding to the signal of the auxiliary pressure sensor, respectively, when the pressure sensor is abnormal.

4. The apparatus of claim 3, further comprising:

an auxiliary mode switch connected with the controller and for selectively outputting an auxiliary mode signal to the controller;

wherein the controller outputs a signal corresponding to a predetermined value to the electro proportional control valve when the auxiliary mode signal is received.

5. The apparatus of claim 3, further comprising:

an auxiliary mode switch connected with the controller and for selectively outputting an auxiliary mode signal to the controller;

wherein the auxiliary mode switch operates when both the pressure sensor and the auxiliary pressure sensor are abnormal; and the controller outputs a signal corresponding to a predetermined value to the electro proportional control valve when the auxiliary mode signal is received.

6. The apparatus of claim 2, wherein the auxiliary pressure sensor and the shuttle valves are provided to a number corresponding to a number of main pumps; and the controller controls the electro proportional control valve corresponding to the signal of the auxiliary pressure sensor, respectively, when the pressure sensor is abnormal.

* * * * *